United States Patent [19]

Patin

[11] 4,078,958

[45] Mar. 14, 1978

[54] MANUFACTURE OF A WIPING ARTICLE HAVING A PAPER BASE

[75] Inventor: Claude Patin, Pont-Audemer, France

[73] Assignee: Cie des Ets. de la Risle-Papeteries de Pont-Audemer, Paris, France

[21] Appl. No.: 710,710

[22] Filed: Aug. 2, 1976

Related U.S. Application Data

[63] Continuation-in-part of Ser. No. 589,690, Jun. 24, 1975, abandoned.

[30] Foreign Application Priority Data

| | | |
|---|---|---|
| Jun. 3, 1975 | France | 75 17242 |
| Jun. 27, 1974 | France | 74 22384 |

[51] Int. Cl.[2] ..... B31F 1/12

[52] U.S. Cl. ..... 156/183; 156/206; 156/229; 156/290; 162/112; 264/283; 428/114; 428/154; 428/192

[58] Field of Search ..... 156/183, 205, 206, 229, 156/220, 181, 62.8, 313, 176, 177, 178, 179, 290, 291, 88; 428/152-154, 192, 248, 249, 255, 247, 257, 110, 109; 26/71, 18.6; 28/72 NW; 264/282, 283; 162/111, 112, 113

[56] References Cited

U.S. PATENT DOCUMENTS

| | | | |
|---|---|---|---|
| 3,025,199 | 3/1962 | Harwood | 428/249 |
| 3,260,778 | 7/1966 | Walton | 264/282 |
| 3,597,299 | 8/1971 | Thomas et al. | 156/183 |
| 3,615,976 | 10/1971 | Endres et al. | 428/198 |
| 3,668,054 | 6/1972 | Stumpf | 156/183 |
| 3,708,383 | 1/1973 | Thomas et al. | 156/179 |
| 3,709,764 | 1/1973 | Thomas | 156/183 |
| 3,773,606 | 11/1973 | Worester, Jr. et al. | 428/246 |

*Primary Examiner*—David Klein
*Assistant Examiner*—Michael W. Ball
*Attorney, Agent, or Firm*—Holman & Stern

[57] ABSTRACT

Method of manufacture of a hand-towel strip to be used in roll form in an automatic distributor with re-winding of the used portion, wherein a composite web comprising a flexible grid covered on each face with a layer of cellulose wadding, is dry creped and said creping is completely removed by stretching the composite web to a length superior to its initial length.

5 Claims, 4 Drawing Figures

MANUFACTURE OF A WIPING ARTICLE HAVING A PAPER BASE

RELATED APPLICATION

This application is a Continuation-in-Part of my copending application Ser. No. 589,690, fled June 24, 1975, and entitled "Manufacture of a wiping article having a paper base", now abandoned.

BACKGROUND OF THE INVENTION

This invention relates to the manufacture of a hand-towel strip, having a cellulose wadding base, and to be used in roll form, in an automatic distributor with rewinding of the used portion.

In such distributors, the towel is pulled downwardly by the user, to gain access to a clean portion, whereas a used portion is simultaneously re-rolled.

PRIOR ART

Wiping articles having a cellulose wadding base have already been employed in the prior art. In one known design, a loose-mesh textile grid is bonded between two sheets of paper such as, for example, two sheets of creped cellulose wadding. Bonding of the paper sheets to the grid is performed by means of a water-resistant adhesive which is distributed solely along the threads which form the grid. Thus, the greater part of the surfaces of the sheets is devoid of adhesive which would be liable to reduce the absorption capacities and the qualities of suppleness of the product.

Methods are known also to improve the suppleness and absorption properties of wiping articles of the aforementioned type. Such methods are described, for example, in U.S. Pat. Nos. 3,708,383, 3,597,299, and consists essentially in creping and partially unpleating the composite web constituted by the cellulose wadding bonded on each face of the grid. The creping may be carried out suitably in the apparatus described in U.S. Pat. No. 3,260,778.

The wiping articles of the prior art are quite suitable when used in sheet form. However, after creping, and even after partial unpleating, they are still stretchable, which is particularly due to the remaining pleats, and when they are stretched in a direction perpendicular to the pleats, there is a remanent elongation.

OBJECT AND SUMMARY OF THE INVENTION

An automatic distributor of a hand-towel strip, with rewinding of the used portion, is provided with a mechanism such that the peripheric displacement of the clean strip roll and the peripheric displacement of the used strip roll are the same. If, when pulled downwardly, there is a permanent or at least a remanent elongation of the strip between the clean strip roll and the used strip roll, the length of strip between the two rolls, i.e., outside the distributor, will become longer and longer. Each time the strip is pulled outside the distributor, the re-rolled length of used portion is only the same as the unrolled length of clean portion, said unrolled length of clean portion being elongated only after leaving the clean strip roll. If the length of of strip outside the distributor becomes longer and longer, used portions of the strip remain outside the distributor, which, of course, is highly undesirable. It is now apparent that the wiping articles of the prior art cannot be used in an automatic distributor of the aforementioned type.

A hand-towel strip to be used in an automatic distributor must be strong enough to preclude tearing when pulled downwarly. A sufficient tensile strength may be obtained by increasing the number and/or the strength of the threads forming the grid. However, this results in an increase of the stiffness of the strip, and a loss of the absorption capacities since the amount of adhesive is also increased.

It is a main object of the invention to provide a method of manufacture of a hand-towel strip to be used in roll form in an automatic distributor with rewinding of the used portion, said strip having no permanent or remanent elongation when pulled out of said distributor, and being strong enough to preclude tearing when pulled, but having good suppleness and absorption capacities.

To this end, the method according to the invention comprises:

forming a composite web comprising at least one flexible grid covered on each face with a layer of creped cellulose wadding, said layers being bonded solely along the threads which constitute said grid, said grid having warp threads more closely spaced along the edges of said strip;

forming a plurality of transverse pleats by additional dry creping, on at least portions of the width of said composite web removing completely said additional creping, by stretching said composite web to a length superior to its initial length before said additional creping, but within the elastic limit of said grid, and within residual elongation of the cellulose wadding.

It has been found that stretching the composite web to a length superior to its initial length before the additional creping avoids a remanent elongation of said composite web when used in a distributor. The composite web must be stretched within the elastic limit of the grid, otherwise there would be a permanent elongation when used in a distributor. Such a stretching is also possible because the layers of cellulose wadding are already creped before being bonded to the grid. By "residual elongation" it is meant in this context, and in accordance with accepted usage, in the paper industry, the capacity for elongation without breaking.

When pulling downwardly the strip out of the distributor, the user grasps the strip on the edges, and therefore it is only necessary to reinforce the edges of the strip. This provides the advantage that the main part of the strip is not stiffened, and also that the costs are minimized.

The additional dry creping may be performed along the entire width of the composite web, on only portions of the width. In the latter case the transverse stiffening due to the creping is reduced.

BRIEF DESCRIPTION OF THE DRAWINGS

The invention will be better understood from the following description and from the accompanying drawings, wherein.

DESCRIPTION OF THE PREFERRED EMBODIMENTS

Figures 1, 2:
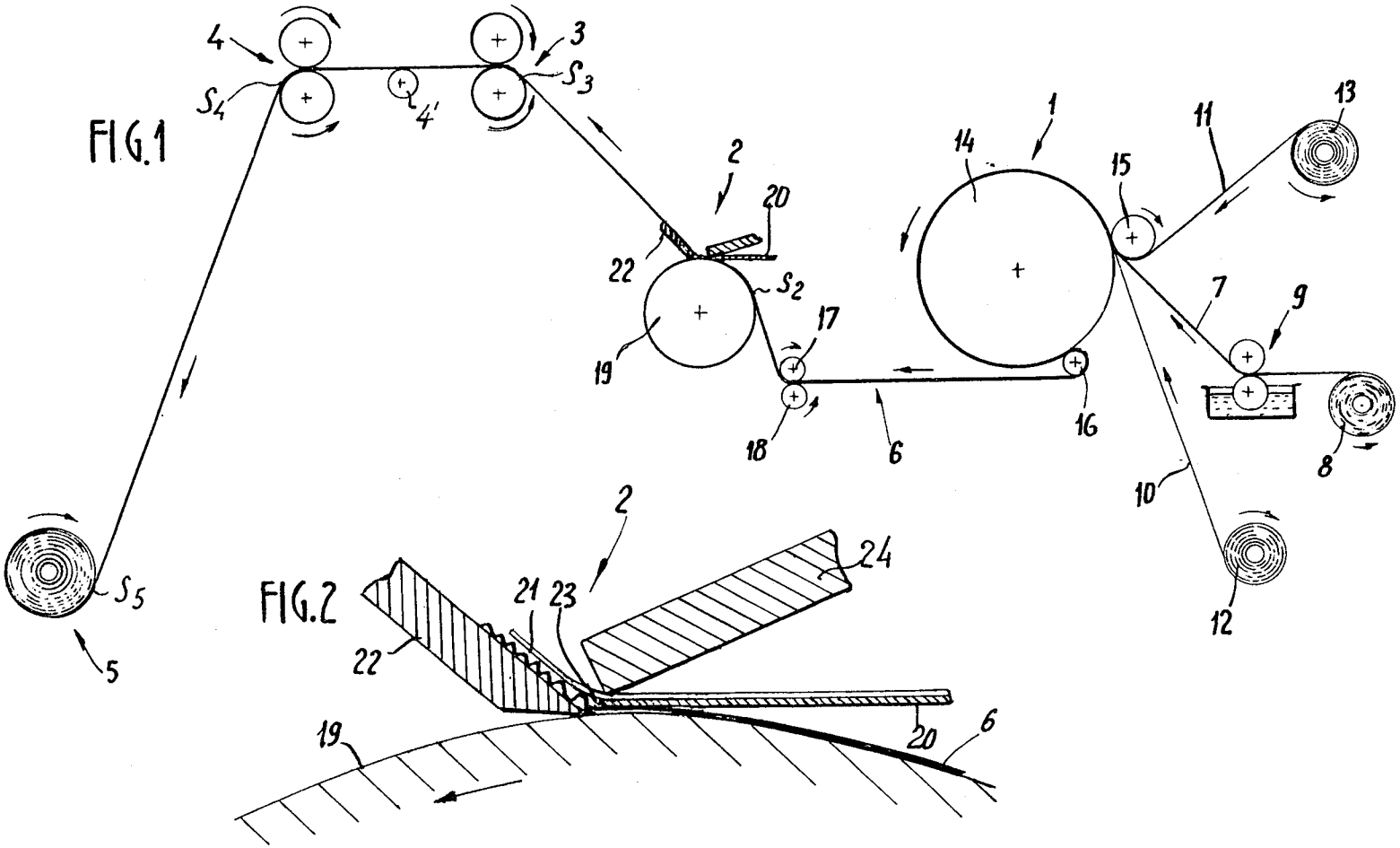
FIG. 1 is a diagrammatic view of an apparatus for the practical application of the method according to the invention.
FIG. 2 is a detail view showing diagrammatically a portion of the apparatus of FIG. 1.

The apparatus shown in FIG. 1 comprises a station 1 for forming a composite web, a device 2 for creping said web in the dry state, a first drawing press 3, a second drawing and crimping press 4 and a storage reel 5.

At the station 1 for the formation of a composite web 6, a continuous flexible grid 7 supplied from a reel 8 is covered on each face, after gluing at the station 9, with a layer of creped cellulose wadding 10 and 11 respectively supplied from the reels 12 and 13 respectively. The assembly constituted by the grid 7 covered with the layers 10 and 11 is pressed between two heated cylinders 14 and 15 and forms the composite web 6. The grid 7 can be constituted for example by threads of nylon, polyethylene, polypropylene or polyester. The layers 10 and 11 are bonded only in the immediate vicinity of the threads constituting the grid 7 in such a manner as to ensure that the greater part of the surface of said layers is not coated with adhesive, with the result that good properties of suppleness and absorption are retained. Taking account of the applications which are comtemplated for the composite web 6, it is wholly apparent that the adhesive employed at the gluing station 9 must have suitable properties of resistance to water. In FIG. 1, the references 16, 17 and 18 designate guide cylinders.

The device 2 for creping the composite web 6 in the dry state is of the type described in U.S. Pat. No. 3,260,778. Said device 2 which is shown partially in detail in FIG. 2 comprises a cylinder 19 coated with a hard product such as silicon carbide having fine surface excrescences, a steel blade 20 having a very low coefficient of friction with the paper, a flexible steel blade 21 forming an extension of the blade 20, a gap 23 of adjustable width being formed between said flexible blade 21 and a backing blade 22 of hard steel, the width of said gap being dependent on the nature and mode of attachment of the flexible blade 21 and on the position of the backing blade 22 with respect to said flexible blade. The reference 24 designates a pressure plate.

The composite web 6 which is displaced by the cylinder 19 collects within the gap 23 and forms a plurality of transverse pleats which are spaced at a distance not exceeding approximately 2 mm and constitute a crepe texture.

Assuming that $S_2$ is the speed at which the composite web 6 is fed into the creping device 2, the speed $S_3$ in the first drawing press 3 is lower than $S_2$, and $S_3$ is as much lower as the crepe ratio is higher. In order to remove completely, the creping performed in creping device 2, the speed $S_4$ of the second drawing and crimping press 4 must be higher than the feeding speed $S_2$ in the creping device 2, so that the composite web 6 is stretched to a length greater than its initial length before creping, but within the elastic limit of the grid 7 and within residual elongation of the cellulose wadding 10, 11. The composite web is then wound on a storage reel 5 with a speed $S_5$ substantailly the same as the feeding speed $S_2$ in the creping device 2.

In order to avoid formation of longitudinal pleats in the composite web 6 before passing into the second drawing and crimping press 4, a cambered cylinder 4' is advantageously provided just before said press 4.

Tests have been carried out with a composite web having a grid constituted of polyester threads of about 170 decitex and having a tensile strength of about 1 kg, the initial crepe ratio of cellulose wadding, prior to the dry creping of the composite web, being approximately of 15%.

Good results are obtained with a speed $S_3$ in the first drawing press 3, being 70% of the feeding speed $S_2$ in the creping device 2, which corresponds to an additional creping ratio of about 30%, and with a speed $S_4$ being 105% of $S_2$.

To preclude tearing of the hand-towel strip when pulled outside the distributor by a user, each edge of the strip is provided with a longitudinal zone of about 5 cm, having a tensile strength of about 15 to about 20 kg, i.e., having 15 to 20 polyester warp threads of the aforementioned type. The spacing between the fill threads, and the spacing between the warp threads outside the longitudinal zones, may be any conventional spacing in such articles.

Figure 3:
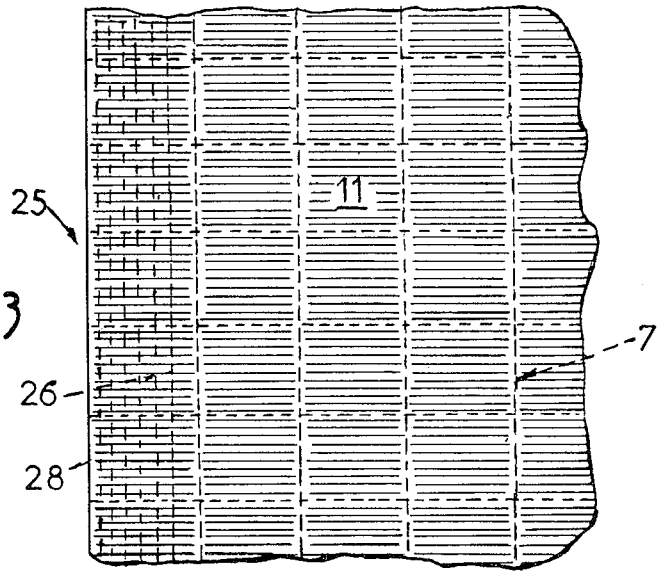
FIG. 3 shows a hand-towel strip obtained by means of the apparatus of FIGS. 1 and 2.

A completed hand-towel strip or composite web 25 is shown in the plan view of FIG. 3. The article therefore comprises a flexible grid 7 (shown in broken lines) in which the warp threads 26 are more closely spaced along the edge 28, each face of the grid 7 being covered with a layer of cellulose wadding such as the layer 11 shown in FIG. 1.

The composite web 25 has been creped on its entire width in the dry creping device 2.

Figure 4:
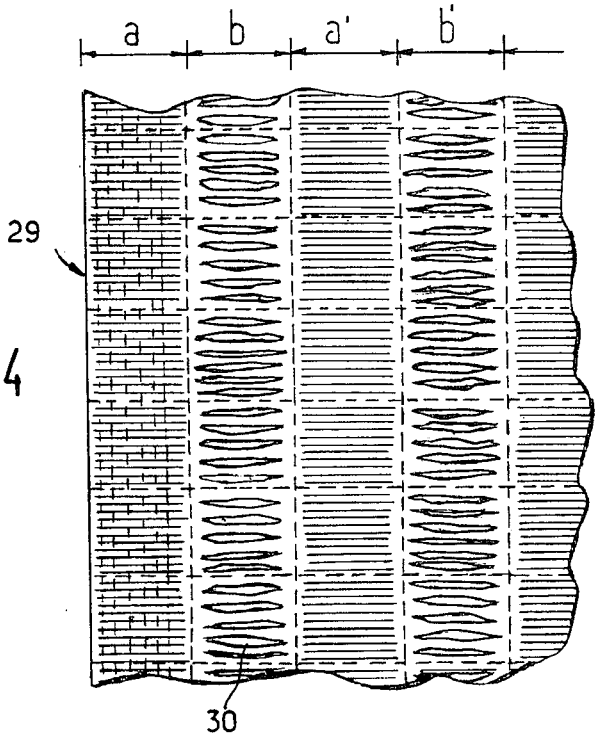
FIG. 4 shows another embodiment of a hand-towel strip in accordance with the invention.

The composite web 29 shown in FIG. 4 has substantially the same structure as that of the composite web 25, but it was creped only on portions such as *a, a'* of its width, whereas puckers 30 were formed in the non-creped zones such as *b, b'*.

What I claim is:

1. A method of manufacture of a hand-towel strip to be used in an automatic distributor in which a clean strip is withdrawn from a clean strip roll and the used portion is rewound on a used strip roll, wherein said method comprises:

forming a composite web comprising at least one flexible grid covered on each face with a layer of creped cellulose wadding, said layers being bonded solely along the threads which constitute said grid, said grid having warp threads more closely spaced along the edges of said strip, forming a plurality of transverse pleats by additional dry creping, on at least portions of the width of said composite web, removing completely said additional creping, by stretching said composite web to a length superior to its initial length before said additional creping, but within the elastic limit of said grid, and within residual elongation of the cellulose wadding, whereby the resultant hand-towel strip has good suppleness and absorption properties, good tensile strength at least along the edges to permit withdrawal of the strip from the clean strip roll without tearing, and no permanent or remanent elongation so that the portion of the strip between the clean and used strip rolls does not increase in length in use.

2. The method according to claim 1, which comprises:

drawing the composite web, out of a dry creping device, with a first drawing press, at a speed of about 70% of the feeding speed in said creping device, drawing said composite web, with a second drawing press, after passing through said first drawing press, at a speed of about 105% of the feeding speed in said creping device, winding said composite web on a storage reel with a speed about the same as the feeding speed in said creping device.

3. The method according to claim 2 comprising passing said composite web on a cambered cylinder before passing through the second drawing press and after passing through the first drawing press.

4. The method according to claim 3 wherein transverse pleats are formed over the entire width of the composite web, during the additional creping.

5. The method according to claim 4 wherein the second drawing press is a crimping press.

* * * * *